US009932535B2

(12) United States Patent
Reid

(10) Patent No.: US 9,932,535 B2
(45) **Date of Patent: *Apr. 3, 2018**

(54) DIESEL FUEL COMPOSITIONS

(75) Inventor: Jacqueline Reid, Cymau (GB)

(73) Assignee: INNOSPEC LIMITED, Cheshire (GB)

( * ) Notice: Subject to any disclaimer, the term of this patent is extended or adjusted under 35 U.S.C. 154(b) by 441 days.

This patent is subject to a terminal disclaimer.

(21) Appl. No.: 14/236,759

(22) PCT Filed: Aug. 2, 2012

(86) PCT No.: PCT/GB2012/051875

§ 371 (c)(1),
(2), (4) Date: Feb. 3, 2014

(87) PCT Pub. No.: WO2013/017884

PCT Pub. Date: Feb. 7, 2013

(65) Prior Publication Data

US 2014/0157657 A1 Jun. 12, 2014

(30) Foreign Application Priority Data

Aug. 3, 2011 (GB) ..... 1113390.7

(51) Int. Cl.
*C10L 1/22* (2006.01)
*C10L 10/04* (2006.01)
(Continued)

(52) U.S. Cl.
CPC ..... *C10L 10/04* (2013.01); *C10L 1/146* (2013.01); *C10L 1/238* (2013.01); *C10L 1/2383* (2013.01);
(Continued)

(58) Field of Classification Search
CPC ..... C10L 1/1616; C10L 1/2387; C10L 1/146; C10L 1/198; C10L 1/238; C10L 1/2383;
(Continued)

(56) References Cited

U.S. PATENT DOCUMENTS 3,018,250 A 1/1962 Anderson et al.
3,172,892 A 3/1965 Le Suer et al.
(Continued)

FOREIGN PATENT DOCUMENTS

EP 1344785 A1 9/1993
EP 0565285 A1 10/1993
(Continued)

OTHER PUBLICATIONS

International Preliminary Report on Patentability for International Application No. PCT/GB2012/051875 dated Feb. 4, 2014.

*Primary Examiner* — Latosha Hines
(74) *Attorney, Agent, or Firm* — Burns & Levinson LLP; Janine M. Susan

(57) ABSTRACT

A diesel fuel composition comprising a first additive (i) comprising a quaternary ammonium salt and a second additive (ii) comprising a Mannich reaction product; wherein the quaternary ammonium salt additive (i) is formed by the reaction of a compound of formula (A): R O O R1 10 (A) and a compound formed by the reaction of a hydrocarbyl-substituted acylating agent and an amine of formula (B1) or (B2): 15 N X R3 R2 NHR4 N X R3 R2 [O(CH2) m]nOH (B1) (B2) wherein R is an optionally substituted alkyl, alkenyl, aryl or alkylaryl group; R1 is a C1 to C22 alkyl, aryl or alkylaryl group; wherein R2 and R3 are the same or different alkyl, alkenyl or aryl groups having from 1 to 22 carbon atoms; X is a bond or alkylene group having from 1 to 20 20 carbon atoms; n is from 0 to 20; m is from 1 to 5; and R4 is hydrogen or a C1 to C22 alkyl group; and wherein the Mannich reaction product additive (ii) is the product of a Mannich reaction between: (d) an aldehyde; (e) an amine; and25 (f) a substituted phenol; wherein the phenol is substituted with at least one branched hydrocarbyl group having a molecular weight of between 200 and 3000.

13 Claims, 1 Drawing Sheet

(51) Int. Cl.

| | |
|---|---|
| ***C10L 1/14*** | (2006.01) |
| ***C10L 1/238*** | (2006.01) |
| ***C10L 1/2383*** | (2006.01) |
| ***C10L 10/18*** | (2006.01) |
| *C10L 1/16* | (2006.01) |
| *C10L 1/198* | (2006.01) |
| *C10L 1/2387* | (2006.01) |
| *C10L 1/28* | (2006.01) |

(52) U.S. Cl.
CPC ..... *C10L 10/18* (2013.01); *C10L 1/1616* (2013.01); *C10L 1/198* (2013.01); *C10L 1/2387* (2013.01); *C10L 1/285* (2013.01); *C10L 2270/026* (2013.01)

(58) Field of Classification Search
CPC ..... C10L 1/285; C10L 2300/20; C10L 2270/026; C10L 10/04; C10L 10/08
USPC ..... 44/399; 123/1 A
See application file for complete search history.

(56) References Cited

U.S. PATENT DOCUMENTS

| | | | | |
|---|---|---|---|---|
| 3,361,673 | A | 1/1968 | Stuart et al. | |
| 4,248,179 | A * | 2/1981 | Bonner | F28F 1/40 122/235.14 |
| 4,248,719 | A * | 2/1981 | Chafetz | C07D 207/412 508/293 |
| 2008/0307698 | A1 | 12/2008 | Barton et al. | |

FOREIGN PATENT DOCUMENTS

| | | | | |
|---|---|---|---|---|
| EP | 0831141 | A1 | 3/1998 | |
| EP | 1254889 | A1 * | 11/2002 | C07C 209/20 |
| GB | 949981 | A | 2/1964 | |
| GB | 2453249 | A * | 4/2009 | C10L 1/22 |
| WO | 2007015080 | A1 | 2/2007 | |
| WO | 2009040583 | A1 | 4/2009 | |
| WO | 2010097624 | A1 | 9/2010 | |
| WO | WO 2010097624 | A1 * | 9/2010 | C10L 10/00 |
| WO | 2011095819 | A1 | 8/2011 | |

* cited by examiner

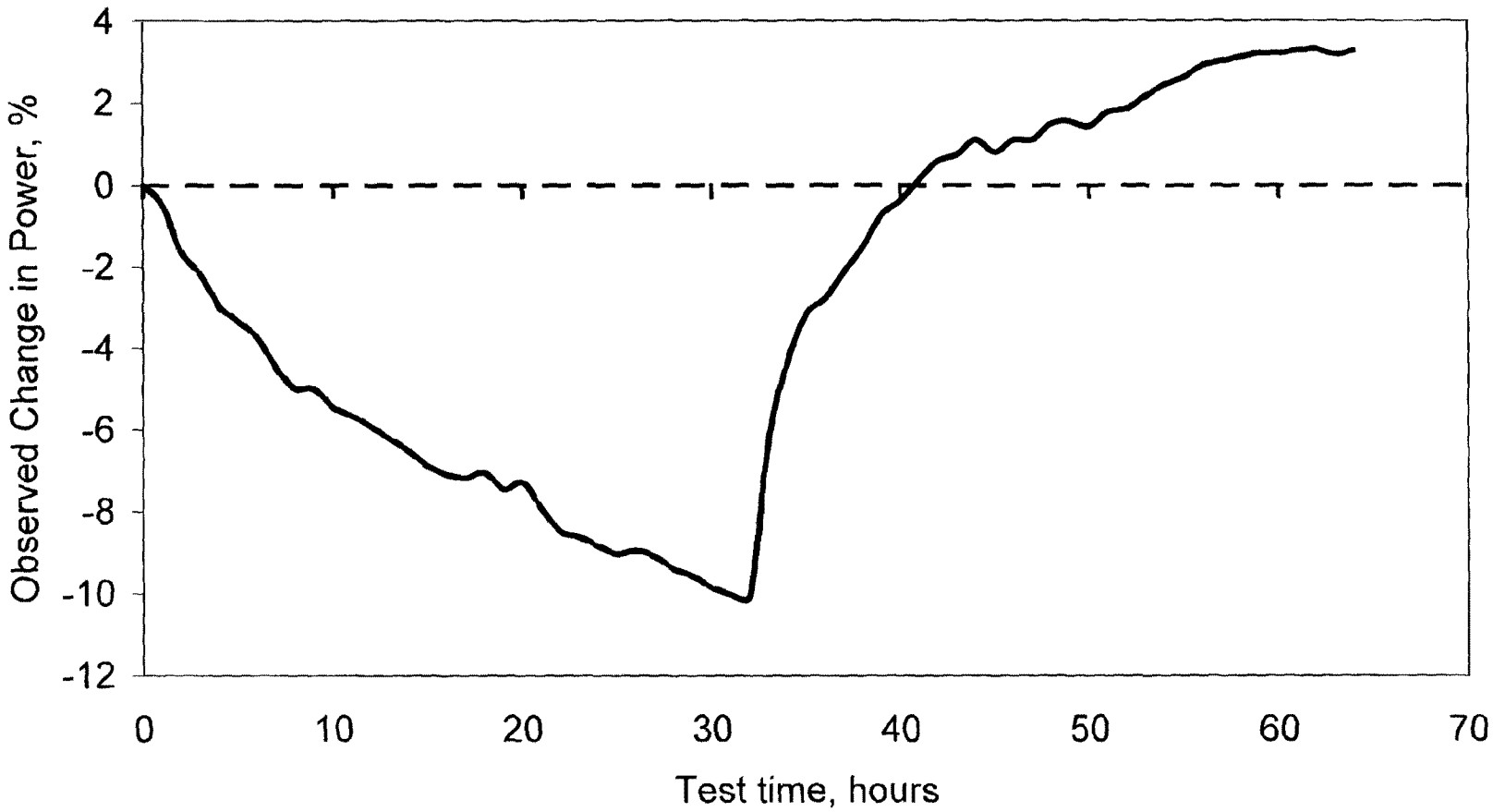
Observed Change in Power, %
4
2
0
-2
-4
-6
-8
-10
-12
0
10
20
30
40
50
60
70
Test time, hours

DIESEL FUEL COMPOSITIONS

CROSS-REFERENCE TO RELATED APPLICATIONS

This application is a U.S. national stage application under 35 U.S.C. 371 of co-pending International Application No, PCT/GB2012/051875 flied on Aug. 2, 2012 and entitled FUEL COMPOSITIONS, which in turn claims priority to Great Britain Patent Application No. 1113390.7, filed on Aug. 3, 2011, which is incorporated by reference herein in its entirety for all purposes.

BACKGROUND

The present invention relates to fuel compositions and additives thereto. In particular the invention relates to additives for diesel fuel compositions, especially those suitable for use in modern diesel engines with high pressure fuel systems.

Due to consumer demand and legislation, diesel engines have in recent years become much more energy efficient, show improved performance and have reduced emissions.

These improvements in performance and emissions have been brought about by improvements in the combustion process. To achieve the fuel atomisation necessary for this improved combustion, fuel injection equipment has been developed which uses higher injection pressures and reduced fuel injector nozzle hole diameters. The fuel pressure at the injection nozzle is now commonly in excess of 1500 bar ($1.5\times10^8$ Pa). To achieve these pressures the work that must be done on the fuel also increases the temperature of the fuel. These high pressures and temperatures can cause degradation of the fuel.

Diesel engines having high pressure fuel systems can include but are not limited to heavy duty diesel engines and smaller passenger car type diesel engines. Heavy duty diesel engines can include very powerful engines such as the MTU series 4000 diesel having 20 cylinder variants designed primarily for ships and power generation with power output up to 4300 kW or engines such as the Renault dXi 7 having 6 cylinders and a power output around 240 kW. A typical passenger car diesel engine is the Peugeot DW10 having 4 cylinders and power output of 100 kW or less depending on the variant.

In all of the diesel engines relating to this invention, a common feature is a high pressure fuel system. Typically pressures in excess of 1350 bar ($1.35\times10^8$ Pa) are used but often pressures of up to 2000 bar ($2\times10^8$ Pa) or more may exist.

Two non-limiting examples of such high pressure fuel systems are: the common rail injection system, in which the fuel is compressed utilizing a high-pressure pump that supplies it to the fuel injection valves through a common rail; and the unit injection system which integrates the high-pressure pump and fuel injection valve in one assembly, achieving the highest possible injection pressures exceeding 2000 bar ($2\times10^8$ Pa). In both systems, in pressurising the fuel, the fuel gets hot, often to temperatures around 100° C., or above.

In common rail systems, the fuel is stored at high pressure in the central accumulator rail or separate accumulators prior to being delivered to the injectors. Often, some of the heated fuel is returned to the low pressure side of the fuel system or returned to the fuel tank. In unit injection systems the fuel is compressed within the injector in order to generate the high injection pressures. This in turn increases the temperature of the fuel.

In both systems, fuel is present in the injector body prior to injection where it is heated further due to heat from the combustion chamber. The temperature of the fuel at the tip of the injector can be as high as 250-350° C.

Thus the fuel is stressed at pressures from 1350 bar ($1.35\times10^8$ Pa) to over 2000 bar ($2\times10^8$ Pa) and temperatures from around 100° C. to 350° C. prior to injection, sometimes being recirculated back within the fuel system thus increasing the time for which the fuel experiences these conditions.

A common problem with diesel engines is fouling of the injector, particularly the injector body, and the injector nozzle. Fouling may also occur in the fuel filter. Injector nozzle fouling occurs when the nozzle becomes blocked with deposits from the diesel fuel. Fouling of fuel filters may be related to the recirculation of fuel back to the fuel tank. Deposits increase with degradation of the fuel. Deposits may take the form of carbonaceous coke-like residues or sticky or gum-like residues. Diesel fuels become more and more unstable the more they are heated, particularly if heated under pressure. Thus diesel engines having high pressure fuel systems may cause increased fuel degradation.

The problem of injector fouling may occur when using any type of diesel fuels. However, some fuels may be particularly prone to cause fouling or fouling may occur more quickly when these fuels are used. For example, fuels containing biodiesel have been found to produce injector fouling more readily. Diesel fuels containing metallic species may also lead to increased deposits. Metallic species may be deliberately added to a fuel in additive compositions or may be present as contaminant species. Contamination occurs if metallic species from fuel distribution systems, vehicle distribution systems, vehicle fuel systems, other metallic components and lubricating oils become dissolved or dispersed in fuel.

Transition metals in particular cause increased deposits, especially copper and zinc species. These may be typically present at levels from a few ppb (parts per billion) up to 50 ppm, but it is believed that levels likely to cause problems are from 0.1 to 50 ppm, for example 0.1 to 10 ppm.

When injectors become blocked or partially blocked, the delivery of fuel is less efficient and there is poor mixing of the fuel with the air. Over time this leads to a loss in power of the engine, increased exhaust emissions and poor fuel economy.

As the size of the injector nozzle hole is reduced, the relative impact of deposit build up becomes more significant. By simple arithmetic a 5 μm layer of deposit within a 500 μm hole reduces the flow area by 4% whereas the same 5 μm layer of deposit in a 200 μm hole reduces the flow area by 9.8%.

At present, nitrogen-containing detergents may be added to diesel fuel to reduce coking. Typical nitrogen-containing detergents are those formed by the reaction of a polyisobutylene-substituted succinic acid derivative with a polyalkylene polyamine. However, newer engines including finer injector nozzles are more sensitive and current diesel fuels may not be suitable for use with the new engines incorporating these smaller nozzle holes.

The present inventor has developed diesel fuel compositions which when used in diesel engines having high pressure fuel systems provide improved performance compared with diesel fuel compositions of the prior art.

It is advantageous to provide a diesel fuel composition which prevents or reduces the occurrence of deposits in a diesel engine. Such fuel compositions may be considered to perform a "keep clean" function i.e. they prevent or inhibit fouling.

However it would also be desirable to provide a diesel fuel composition which would help clean up deposits that have already formed in an engine, in particular deposits which have formed on the injectors. Such a fuel composition which when combusted in a diesel engine removes deposits therefrom thus effecting the "clean-up" of an already fouled engine.

As with "keep clean" properties, "clean-up" of a fouled engine may provide significant advantages. For example, superior clean up may lead to an increase in power and/or an increase in fuel economy. In addition removal of deposits from an engine, in particular from injectors may lead to an increase in interval time before injector maintenance or replacement is necessary thus reducing maintenance costs.

Although for the reasons mentioned above deposits on injectors is a particular problem found in modern diesel engines with high pressure fuels systems, it is desirable to provide a diesel fuel composition which also provides effective detergency in older traditional diesel engines such that a single fuel supplied at the pumps can be used in engines of all types.

It is also desirable that fuel compositions reduce the fouling of vehicle fuel filters. It would be useful to provide compositions that prevent or inhibit the occurrence of fuel filter deposits i.e, provide a "keep clean" function. It would be useful to provide compositions that remove existing deposits from fuel filter deposits i.e. provide a "clean up" function. Compositions able to provide both of these functions would be especially useful.

BRIEF SUMMARY

According to a first aspect of the present invention there is provided a diesel fuel composition comprising a first additive (i) comprising a quaternary ammonium salt and a second additive (ii) comprising a Mannich reaction product; wherein the quaternary ammonium salt additive (i) is formed by the reaction of a compound of formula (A):

(A)

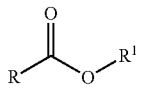

and a compound formed by the reaction of a hydrocarbyl-substituted acylating agent and an amine of formula (B1) or (B2):

(B1)

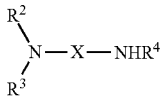

(B2)

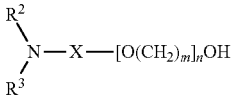

wherein R is an optionally substituted alkyl, alkenyl, aryl or alkylaryl group; $R^1$ is a $C_1$ to $C_{22}$ alkyl, aryl or alkylaryl group; wherein $R^2$ and $R^3$ are the same or different alkyl, alkenyl or aryl groups having from 1 to 22 carbon atoms; X is a bond or alkylene group having from 1 to 20 carbon atoms; n is from 0 to 20; m is from 1 to 5; and $R^4$ is hydrogen or a $C_1$ to $C_{22}$ alkyl group; and wherein the Mannich reaction product additive (ii) is the product of a Mannich reaction between:

(a) an aldehyde;

(b) an amine; and (c) a substituted phenol;

wherein the phenol is substituted with at least one branched hydrocarbyl group having a molecular weight of between 200 and 3000.

BRIEF DESCRIPTION OF THE DRAWINGS

FIG. 1 is a graph showing the test results of Example 7 of this disclosure.

DETAILED DESCRIPTION

Additive compounds (i) may be referred to herein as "the quaternary ammonium salt additives" or additive (i).

Additive compounds (II) may be referred to herein as "the Mannich additives" or additive (ii). The compound of formula (A) used to prepare additive (i) is an ester of a carboxylic acid capable of reacting with a tertiary amine to form a quaternary ammonium salt.

Suitable compounds of formula (A) include esters of carboxylic acids having a $pK_a$ of 3.5 or less.

The compound of formula (A) is preferably an ester of a carboxylic acid selected from a substituted aromatic carboxylic acid, an α-hydroxycarboxylic acid and a polycarboxylic acid.

In some preferred embodiments the compound of formula (A) is an ester of a substituted aromatic carboxylic acid and thus R is a substituted aryl group.

Preferably R is a substituted aryl group having 6 to 10 carbon atoms, preferably a phenyl or naphthyl group, most preferably a phenyl group. R is suitably substituted with one or more groups selected from carboalkoxy, nitro, cyano, hydroxy, $SR^5$ or $NR^5R^6$. Each of $R^5$ and $R^6$ may be hydrogen or optionally substituted alkyl, alkenyl, aryl or carboalkoxy groups. Preferably each of $R^5$ and $R^6$ is hydrogen or an optionally substituted $C_1$ to $C_{22}$ alkyl group, preferably hydrogen or a $C_1$ to $C_{16}$ alkyl group, preferably hydrogen or a $C_1$ to $C_{10}$ alkyl group, more preferably hydrogen$C_1$ to $C_4$ alkyl group. Preferably $R^5$ is hydrogen and $R^6$ is hydrogen or a $C_1$ to $C_4$ alkyl group. Most preferably $R^5$ and $R^6$ are both hydrogen. Preferably R is an aryl group substituted with one or more groups selected from hydroxyl, carboalkoxy, nitro, cyano and $NH_2$. R may be a poly-substituted aryl group, for example trihydroxyphenyl. Preferably R is a mono-substituted aryl group. Preferably R is an ortho substituted aryl group. Suitably R is substituted with a group selected from OH, $NH_2$, $NO_2$ or COOMe. Preferably R is substituted with an OH or $NH_2$ group. Suitably R is a hydroxy substituted aryl group. Most preferably R is a 2-hydroxyphenyl group.

Preferably $R^1$ is an alkyl or alkylaryl group. $R^1$ may be a $C_1$ to $C_{16}$ alkyl group, preferably a $C_1$ to $C_{10}$ alkyl group, suitably a $C_1$ to $C_8$ alkyl group. $R^1$ may be $C_1$ to $C_{16}$ alkylaryl group, preferably a $C_1$ to $C_{10}$ alkylgroup, suitably a $C_1$ to $C_8$ alkylaryl group. $R^1$ may be methyl, ethyl, propyl, butyl, pentyl, benzyl or an isomer thereof. Preferably $R^1$ is benzyl or methyl. Most preferably $R^1$ is methyl.

An especially preferred compound of formula (A) is methyl salicylate.

In some embodiments the compound of formula (A) is an ester of an α-hydroxycarboxylic acid. In such embodiments the compound of formula (A) has the structure:

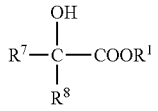

wherein $R^7$ and $R^8$ are the same or different and each is selected from hydrogen, alkyl, alkenyl, aralkyl or aryl. Compounds of this type suitable for use herein are described in EP 1254889.

Examples of compounds of formula (A) in which RCOO is the residue of an □-hydroxycarboxylic acid include methyl-, ethyl-, propyl-, butyl-, pentyl-, hexyl-, benzyl-, phenyl-, and allyl esters of 2-hydroxyisobutyric acid; methyl-, ethyl-, propyl-, butyl-, pentyl-, hexyl-, benzyl-, phenyl-, and allyl esters of 2-hydroxy-2-methylbutyric acid; methyl-, ethyl-, propyl-, butyl-, pentyl-, hexyl-, benzyl-, phenyl-, and allyl esters of 2-hydroxy-2-ethylbutyric acid; methyl-, ethyl-, propyl-, butyl-, pentyl-, hexyl-, benzyl-, phenyl-, and allyl esters of lactic acid; and methyl-, ethyl-, propyl-, butyl-, pentyl-, hexyl-, allyl-, benzyl-, and phenyl esters of glycolic acid. Of the above, a preferred compound is methyl 2-hydroxyisobutyrate.

In some embodiments the compound of formula (A) is an ester of a polycarboxylic acid. In this definition we mean to include dicarboxylic acids and carboxylic acids having more than 2 acidic moieties. In such embodiments RCOO is preferably present in the form of an ester, that is the one or more further acid groups present in the group R are in esterified form. Preferred esters are $C_1$ to $C_4$ alkyl esters.

Compound (A) may be selected from the diester of oxalic acid, the diester of phthalic acid, the diester of maleic acid, the diester of malonic acid or the diester of citric acid. One especially preferred compound of formula (A) is dimethyl oxalate.

In preferred embodiments the compound of formula (A) is an ester of a carboxylic acid having a $pK_a$ of less than 3.5. In such embodiments in which the compound includes more than one acid group, we mean to refer to the first dissociation constant.

Compound (A) may be selected from an ester of a carboxylic acid selected from one or more of oxalic acid, phthalic acid, salicylic acid, maleic acid, malonic acid, citric acid, nitrobenzoic acid, aminobenzoic acid and 2,4,6-trihydroxybenzoic acid.

Preferred compounds of formula (A) include dimethyl oxalate, methyl 2-nitrobenzoate and methyl salicylate.

To form the quaternary ammonium salt additives of the present invention the compound of formula (A) is reacted with a compound formed by the reaction of a hydrocarbyl substituted acylating agent and an amine of formula (B1) or (B2).

When a compound of formula (B1) is used, $R^4$ is preferably hydrogen or a $C_1$ to $C_{16}$ alkyl group, preferably a $C_1$ to $C_{10}$ alkyl group, more preferably a $C_1$ to $C_6$ alkyl group. When $R^4$ is alkyl it may be straight chained or branched. It may be substituted for example with a hydroxy or alkoxy substituent. Preferably $R^4$ is not a substituted alkyl group. More preferably $R^4$ is selected from hydrogen, methyl, ethyl, propyl, butyl and isomers thereof. Most preferably $R^4$ is hydrogen.

When a compound of formula (B2) is used, m is preferably 2 or 3, most preferably 2; n is preferably from 0 to 15, preferably 0 to 10, more preferably from 0 to 5. Most preferably n is 0 and the compound of formula (B2) is an alcohol.

Preferably the hydrocarbyl substituted acylating agent is reacted with a diamine compound of formula (B1).

$R^2$ and $R^3$ are the same or different alkyl, alkenyl or aryl groups having from 1 to 22 carbon atoms. In some embodiments $R^2$ and $R^3$ may be joined together to form a ring structure, for example a piperidine or imidazole moiety. $R^2$ and $R^3$ may be branched alkyl or alkenyl groups. Each may be substituted, for example with a hydroxy or alkoxy substituent.

Preferably $R^2$ and $R^3$ is each independently a $C_1$ to $C_{16}$ alkyl group, preferably a $C_1$ to $C_{10}$ alkyl group. $R^2$ and $R^3$ independently be methyl, ethyl, propyl, butyl, pentyl, hexyl, heptyl, octyl, or an isomer of any of these. Preferably $R^2$ and $R^3$ is each independently $C_1$ to $C_4$ alkyl. Preferably $R^2$ is methyl. Preferably $R^3$ is methyl.

X is a bond or alkylene group having from 1 to 20 carbon atoms. In preferred embodiments when X alkylene group this group may be straight chained or branched. The alkylene group may include a cyclic structure therein. It may be optionally substituted, for example with a hydroxy or alkoxy substituent.

X is preferably an alkylene group having 1 to 16 carbon atoms, preferably 1 to 12 carbon atoms, more preferably 1 to 8 carbon atoms, for example 2 to 6 carbon atoms or 2 to 5 carbon atoms. Most preferably X is an ethylene, propylene or butylene group, especially a propylene group.

Examples of compounds of formula (B1) suitable for use herein include 1-aminopiperidine, 1-(2-aminoethyl)piperidine, 1-(3-aminopropyl)-2-pipecoline, 1-methyl-(4-methylamino)piperidine, 4-(1-pyrrolidinyl)piperidine, 1-(2-aminoethyl)pyrrolidine, 2-(2-aminoethyl)-1-methylpyrrolidine, N,N-diethylethylenediamine, N,N-dimethylethylenediamine, N,N-dibutylethylenediamine, N,N-diethyl-1,3-diaminopropane, N,N-dimethyl-1,3-diaminopropane, N,N,N'-trimethylethylenediamine, N,N-dimethyl-N'-ethylethylenediamine, N,N-diethyl-N'-methylethylenediamine, N,N,N'-triethylethylenediamine, 3-dimethylaminopropylamine, 3-diethylaminopropylamine, 3-dibutylaminopropylamine, N,N,N'-trimethyl-1,3-propanediamine, N,N,2,2-tetramethyl-1,3-propanediamine, 2-amino-5-diethylaminopentane, N,N,N',N'-tetraethyldiethylenetriamine, 3,3'-diamino-N-methyldipropylamine, 3,3'-iminobis(N,N-dimethylpropylamine), 1-(3-aminopropyl) imidazole and 4-(3-aminopropyl)morpholine, 1-(2-aminoethyl)piperidine, 3,3-diamino-N-methyldipropylamine, 3,3-aminobis(N,N-dimethylpropylamine), or combinations thereof.

In some preferred embodiments the compound of formula (B1) is selected from N,N-dimethyl-1,3-diaminopropane, N,N-diethyl-1,3-diaminopropane, N,N-dimethylethylenediamine, N,N-diethylethylenediamine, N,N-dibutylethylenediamine, or combinations thereof.

Examples of compounds of formula (B2) suitable for use herein include alkanolamines including but not limited to triethanolamine, N,N-dimethylaminopropanol, N,N-diethylaminopropanol, N,N-diethylaminobutanol, triisopropanolamine, 1-[2-hydroxyethyl]piperidine, 2-[2-(dimethylamine)ethoxy]-ethanol, N-ethyldiethanolamine, N-methyldiethanolamine, N-butyldiethanolamine, N,N-diethylaminoethanol, N,N-dimethylamino-ethanol, 2-dimethylamino-2-methyl-1-propanol.

In some preferred embodiments the compound of formula (B2) is selected from Triisopropanolamine, 1-[2-hydroxyethyl]piperidine, 2-[2-(dimethylamine)ethoxy]-ethanol, N-ethyldiethanolamine, N-methyldiethanolamine, N-butyldiethanolamine, N,N-diethylaminoethanol, N,N-dimethylaminoethanol, 2-dimethylamino-2-methyl-1-propanol, or combinations thereof.

An especially preferred compound of formula (B1) is dimethylaminopropylamine.

The amine of formula (B1) or (B2) is reacted with a hydrocarbyl substituted acylating agent. The hydrocarbyl substituted acylating agent may be based on a hydrocarbyl substituted mono-di-or polycarboxylic acid or a reactive equivalent thereof. Preferably the hydrocarbyl substituted acylating agent is a hydrocarbyl substituted succinic acid compound such as a succinic acid or succinic anhydride.

The hydrocarbyl substituent preferably comprises at least 10, more preferably at least 12, for example 30 or 50 carbon atoms. It may comprise up to about 200 carbon atoms. Preferably the hydrocarbyl substituent has a number average molecular weight (Mn) of between 170 to 2800, for example from 250 to 1500, preferably from 500 to 1500 and more preferably 500 to 1100. An Mn of 700 to 1300 is especially preferred.

The hydrocarbyl based substituents may be made from homo- or interpolymers (e.g. copolymers, terpolymers) of mono- and di-olefins having 2 to 10 carbon atoms, for example ethylene, propylene, butane-1, isobutene, butadiene, isoprene, 1-hexene, 1-octene, etc. Preferably these olefins are 1-monoolefins. The hydrocarbyl substituent may also be derived from the halogenated (e.g. chlorinated or brominated) analogs of such homo- or interpolymers. Alternatively the substituent may be made from other sources, for example monomeric high molecular weight alkenes (e.g. 1-tetra-contene) and chlorinated analogs and hydrochlorinated analogs thereof, aliphatic petroleum fractions, for example paraffin waxes and cracked and chlorinated analogs and hydrochlorinated analogs thereof, white oils, synthetic alkenes for example produced by the Ziegler-Natta process (e.g. poly(ethylene) greases) and other sources known to those skilled in the art. Any unsaturation in the substituent may if desired be reduced or eliminated by hydrogenation according to procedures known in the art.

The term "hydrocarbyl" as used herein denotes a group having a carbon atom directly attached to the remainder of the molecule and having a predominantly aliphatic hydrocarbon character. Suitable hydrocarbyl based groups may contain non-hydrocarbon moieties. For example they may contain up to one non-hydrocarbyl group for every ten carbon atoms provided this non-hydrocarbyl group does not significantly alter the predominantly hydrocarbon character of the group. Those skilled in the art will be aware of such groups, which include for example hydroxyl, oxygen, halo (especially chloro and fluoro), alkoxyl, alkyl mercapto, alkyl sulphoxy, etc. Preferred hydrocarbyl based substituents are purely aliphatic hydrocarbon in character and do not contain such groups.

The hydrocarbyl-based substituents are preferably predominantly saturated, that is, they contain no more than one carbon-to-carbon unsaturated bond for every ten carbon-to-carbon single bonds present. Most preferably they contain no more than one carbon-to-carbon unsaturated bond for every 50 carbon-to-carbon bonds present.

Preferred hydrocarbyl-based substituents are poly-(isobutene)s known in the art. Thus in especially preferred embodiments the hydrocarbyl substituted acylating agent is a polyisobutenyl substituted succinic anhydride.

The preparation of polyisobutenyl substituted succinic anhydrides (PIBSA) is documented in the art. Suitable processes include thermally reacting polyisobutenes with maleic anhydride (see for example U.S. Pat. No. 3,361,673 and U.S. Pat. No. 3,018,250), and reacting a halogenated, in particular a chlorinated, polyisobutene (PIB) with maleic anhydride (see for example U.S. Pat. No. 3,172,892). Alternatively, the polyisobutenyl succinic anhydride can be prepared by mixing the polyolefin with maleic anhydride and passing chlorine through the mixture (see for example GB-A-949,981).

Conventional polyisobutenes and so-called "highly-reactive" polyisobutenes are suitable for use in preparing additive (i) of the present invention. Highly reactive polyisobutenes in this context are defined as polyisobutenes wherein at least 50%, preferably 70% or more, of the terminal olefinic double bonds are of the vinylidene type as described in EP0565285. Particularly preferred polyisobutenes are those having more than 80 mol % and up to 100% of terminal vinylidene groups such as those described in EP1344785.

Other preferred hydrocarbyl groups include those having an internal olefin for example as described in the applicant's published application WO2007/015080.

An internal olefin as used herein means any olefin containing predominantly a non-alpha double bond, that is a beta or higher olefin. Preferably such materials are substantially completely beta or higher olefins, for example containing less than 10% by weight alpha olefin, more preferably less than 5% by weight or less than 2% by weight. Typical internal olefins include Neodene 1518IO available from Shell.

Internal olefins are sometimes known as isomerised olefins and can be prepared from alpha olefins by a process of isomerisation known in the art, or are available from other sources. The fact that they are also known as internal olefins reflects that they do not necessarily have to be prepared by isomerisation.

Some preferred acylating agents for use in the preparation of the quaternary ammonium salt additives of the present invention are polyisobutene-substituted succinic acids or succinic anhydrides. When a compound of formula (B2) is reacted with a succinic acylating agent the resulting product is a succinic ester. When a succinic acylating agent is reacted with a compound of formula (B1) in which $R^4$ is hydrogen the resulting product may be a succinimide or a succinamide. When a succinic acylating agent is reacted with a compound of formula (B1) in which $R^4$ is not hydrogen the resulting product is an amide.

In preferred embodiments, the reaction product of the hydrocarbyl substituted acylating agent and the amine of formula (B1) or (B2) is an imide or an ester.

In especially preferred embodiments the quaternary ammonium salt additives of the present invention are salts of tertiary amines prepared from dimethylamino propylamine and a polyisobutylene-substituted succinic anhydride. The average molecular weight of the polyisobutylene substituent is preferably from 700 to 1300, more preferably from 900 to 1100.

Particularly preferred quaternary ammonium salts of the present invention are the reaction product of a polyisobutenyl succinic acylating agent with dimethylaminopropylamine (N,N dimethyl 1,3 propane diamine) to form the imide and then quaternised using methyl salicylate.

The quaternary ammonium salt additives of the present invention may be prepared by any suitable methods. Such methods will be known to the person skilled in the art and are exemplified herein. Typically the quaternary ammonium salt additives will be prepared by heating a compound of formula (A) and a compound prepared by the reaction of a hydrocarbyl substituted acylating agent with an amine of formula (B1) or (B2) in an approximate 1:1 molar ratio, optionally in the presence of a solvent. The resulting crude reaction mixture may be added directly to a diesel fuel, optionally following removal of solvent. Any by-products or residual starting materials still present in the mixture have not been found to cause any detriment to the performance of the additive. Thus the present invention may provide a diesel fuel composition comprising the reaction product of a compound of formula (A) and a compound formed by reaction of a hydrocarbyl substituted acylating agent and an amine of formula (B1) or (B2).

The composition of the present invention further comprises a second additive (ii) which is the product of a Mannich reaction between:

(a) an aldehyde;

(b) an amine; and (c) a substituted phenol; wherein the phenol is substituted with at least one branched hydrocarbyl group having a molecular weight of between 200 and 3000.

Any aldehyde may be used as aldehyde component (a) of the Mannich additive. Preferably the aldehyde component (a) is an aliphatic aldehyde. Preferably the aldehyde has 1 to 10 carbon atoms, preferably 1 to 6 carbon atoms, more preferably 1 to 3 carbon atoms. Most preferably the aldehyde is formaldehyde.

Amine component (b) of the Mannich additive may be at least one amino or polyamino compound having at least one NH group. Suitable amino compounds include primary or secondary monoamines having hydrocarbon substituents of 1 to 30 carbon atoms or hydroxyl-substituted hydrocarbon substituents of 1 to about 30 carbon atoms.

In preferred embodiments the amine component (b) is a polyamine.

Polyamines may be selected from any compound including two or more amine groups. Preferably the polyamine is a (poly)alkylene polyamine (by which is meant an alkylene polyamine or a polyalkylene polyamine; including in each case a diamine, within the meaning of "polyamine"). Preferably the polyamine is a (poly)alkylene polyamine in which the alkylene component has 1 to 6, preferably 1 to 4, most preferably 2 to 3 carbon atoms. Most preferably the polyamine is a (poly) ethylene polyamine (that is, an ethylene polyamine or a polyethylene polyamine).

Preferably the polyamine has 2 to 15 nitrogen atoms, preferably 2 to 10 nitrogen atoms, more preferably 2 to 8 nitrogen atoms.

Preferably the polyamine component (b) includes the moiety $R^1R^2NCHR^3CHR^4NR^5R^6$ wherein each of $R^1$, $R^2$, $R^3$, $R^4$, $R^5$ and $R^6$ is independently selected from hydrogen, and an optionally substituted alkyl, alkenyl, alkynyl, aryl, alkylaryl or arylalkyl substituent.

Thus the polyamine reactants used to make the Mannich reaction products of the present invention preferably include an optionally substituted ethylene diamine residue.

Preferably at least one of $R^1$ and $R^2$ is hydrogen. Preferably both of $R^1$ and $R^2$ are hydrogen.

Preferably at least two of $R^1$, $R^2$, $R^5$ and $R^6$ are hydrogen.

Preferably at least one of $R^3$ and $R^4$ is hydrogen. In some preferred embodiments each of $R^3$ and $R^4$ is hydrogen. In some embodiments $R^3$ is hydrogen and $R^4$ is alkyl, for example $C_1$ to $C_4$ alkyl, especially methyl.

Preferably at least one of $R^5$ and $R^6$ is an optionally substituted alkyl, alkenyl, alkynyl, aryl, alkylaryl or arylalkyl substituent.

In embodiments in which at least one of $R^1$, $R^2$, $R^3$, $R^4$, $R^5$ and $R^6$ is not hydrogen, each is independently selected from an optionally substituted alkyl, alkenyl, alkynyl, aryl, alkylaryl or arylalkyl moiety. Preferably each is independently selected from hydrogen and an optionally substituted C(1-6) alkyl moiety.

In particularly preferred compounds each of $R^1$, $R^2$, $R^3$, $R^4$ and $R^5$ is hydrogen and $R^6$ is an optionally substituted alkyl, alkenyl, alkynyl, aryl, alkylaryl or arylalkyl substituent. Preferably $R^6$ is an optionally substituted C(1-6) alkyl moiety.

Such an alkyl moiety may be substituted with one or more groups selected from hydroxyl, amino (especially unsubstituted amino; —NH—, —$NH_2$), sulpho, sulphoxy, C(1-4) alkoxy, nitro, halo (especially chloro or fluoro) and mercapto.

There may be one or more heteroatoms incorporated into the alkyl chain, for example O, N or S, to provide an ether, amine or thioether.

Especially preferred substituents $R^1$, $R^2$, $R^3$, $R^4$, $R^5$ or $R^6$ are hydroxy-C(1-4)alkyl and amino-(C(1-4)alkyl, especially HO—$CH_2$—$CH_2$— and $H_2N$—$CH_2$—$CH_2$—.

Suitably the polyamine includes only amine functionality, or amine and alcohol functionalities.

The polyamine may, for example, be selected from ethylenediamine, diethylenetriamine, triethylenetetramine, tetraethylenepentamine, pentaethylene-hexamine, hexaethyleneheptamine, heptaethyleneoctamine, propane-1,2-diamine, 2(2-amino-ethylamino)ethanol, and N',N'-bis(2-aminoethyl)ethylenediamine ($N(CH_2CH_2NH_2)_3$). Most preferably the polyamine comprises tetraethylenepentamine or ethylenediamine.

Commercially available sources of polyamines typically contain mixtures of isomers and/or oligomers, and products prepared from these commercially available mixtures fall within the scope of the present invention.

The polyamines used to form the Mannich additives of the present invention may be straight chained or branched, and may include cyclic structures.

Phenol component (c) used to prepare the Mannich additives of the present invention may be substituted with 1 to 4 groups on the aromatic ring (in addition to the phenol OH). For example it may be a tri- or di-substituted phenol. Most preferably component (c) is a mono-substituted phenol. Substitution may be at the ortho, and/or meta, and/or para position(s).

Each phenol moiety may be ortho, meta or para substituted with the aldehyde/amine residue. Compounds in which the aldehyde residue is ortho or para substituted are most commonly formed. Mixtures of compounds may result. In preferred embodiments the starting phenol is para substituted and thus the ortho substituted product results.

The phenol may be substituted with any common group, for example one or more of an alkyl group, an alkenyl group, an alkynl group, a nitryl group, a carboxylic acid, an ester, an ether, an alkoxy group, a halo group, a further hydroxyl group, a mercapto group, an alkyl mercapto group, an alkyl sulphoxy group, a sulphoxy group, an aryl group, an arylalkyl group, a substituted or unsubstituted amine group or a nitro group.

As mentioned above the phenol includes at least one branched hydrocarbyl substituent. The hydrocarbyl substituent may be optionally substituted with, for example, hydroxyl, halo, (especially chloro and fluoro), alkoxy, alkyl, mercapto, alkyl sulphoxy, aryl or amino residues. Preferably the hydro carbyl group consists essentially of carbon and hydrogen atoms. The substituted phenol may include an alkenyl or alkynyl residue including one or more double and/or triple bonds.

The hydrocarbyl-based substituents are preferably predominantly saturated, that is, they contain no more than one carbon-to-carbon unsaturated bond for every ten carbon-to-carbon single bonds present. Most preferably they contain no more than one carbon-to-carbon unsaturated bond for every 50 carbon-to-carbon bonds present.

Preferably component (c) is a monoalkyl phenol, especially a para-substituted monoalkyl phenol in which the alkyl chain of the substituent is branched.

In preferred embodiments phenol component (c) used to prepare Mannich reaction product additive (ii) includes a predominantly or completely saturated branched hydrocarbyl substituent. Preferably this predominantly or completely saturated hydrocarbyl substituent is branched along the length of the chain. By branched along the length of the chain we mean that there are multiple branches from the main (or longest) chain. Preferably there is a branch at least every 10 carbon atoms along the main chain, preferably at least every 6 carbons, suitably at least every 4 carbons, for example every 3 carbon atoms or every 2 carbon atoms.

A particular carbon atom in the main hydrocarbyl chain (which is preferably an alkylene chain) may have one or two branching hydrocarbyl groups. By branching hydrocarbyl groups we mean hydrocarbyl groups not forming part of the main chain but directly attached thereto. Thus the main hydrocarbyl chain may include the moiety —$CHR^1$— or —$CR^1R^2$— wherein $R^1$ and $R^2$ are branching hydrocarbyl groups.

Preferably each branching hydrocarbyl group is an alkyl group, preferably a $C_1$ to $C_4$ alkyl group, for example propyl, ethyl or most preferably methyl.

In some preferred embodiments phenol component (c) used to prepare Mannich reaction product additive (ii) includes a hydrocarbyl substituent which is substituted with methyl groups along the main chain thereof. Suitably there are a plurality of carbon atoms which each have two methyl substituents.

Preferably the branching points are substantially equally spaced along the main chain of the hydrocarbyl group of phenol component (c).

Component (c) used to prepare additive (ii) includes at least one branched hydrocarbyl substituent. Preferably this is an alkyl substituent. In especially preferred embodiments the hydrocarbyl substituent is derived from a polyalkene, suitably a polymer of a branched alkene, for example polyisobutene or polypropene.

In especially preferred embodiments component (c) used in the preparation of Mannich reaction product additive (ii) includes a poly(isobutene) derived substituent.

Thus the Mannich reaction product additives (ii) used in the present invention preferably include a hydrocarbyl chain having the repeating unit:

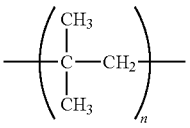

Poly(isobutenes) are prepared by the addition polymerisation of isobutene, $(CH_3)_2C{=}CH_2$. Each molecule of the resulting polymer will include a single alkene moiety.

Conventional polyisobutenes and so-called "highly-reactive" polyisobutenes are suitable for use in preparing additive (ii) of the present invention. Highly reactive polyisobutenes in this context are defined as polyisobutenes wherein at least 50%, preferably 70% or more, of the terminal olefinic double bonds are of the vinylidene type as described in EP0565285. Particularly preferred polyisobutenes are those having more than 80 mol % and up to 100% of terminal vinylidene groups such as those described in EP1344785.

Methods of preparing polyalkylene substituted phenols, for example polyisobutene substituted phenols are known to the person skilled in the art, and include the methods described in EP831141.

The hydrocarbyl substituent of component (c) has an average molecular weight of 200 to 3000. Preferably it has a molecular weight of at least 225, suitably at least 250, preferably at least 275, suitably at least 300, for example at least 325 or at least 350. In some embodiments the hydrocarbyl substituent of component (c) has an average molecular weight of at least 375, preferably at least 400, suitably at least 475, for example at least 500.

In some embodiments component (c) may include a hydrocarbyl substituent having an average molecular weight of up to 2800, preferably up to 2600, for example up to 2500 or up to 2400.

In some embodiments the hydrocarbyl substituent of component (c) has an average molecular weight of from 400 to 2500, for example from 450 to 2400, preferably from 500 to 1500, suitably from 550 to 1300.

In some embodiments the hydrocarbyl substituent of component (c) has an average molecular weight of from 200 to 600.

In some embodiments the hydrocarbyl substituent of component (c) has an average molecular weight of from 500 to 1000.

In some embodiments the hydrocarbyl substituent of component (c) has an average molecular weight of from 700 to 1300.

In some embodiments the hydrocarbyl substituent of component (c) has an average molecular weight of from 1000 to 2000.

In some embodiments the hydrocarbyl substituent of component (c) has an average molecular weight of from 1700 to 2600, for example 2000 to 2500.

Unless otherwise mentioned all average molecular weights referred to herein are number average molecular weights.

Components (a), (b) and (c) used to prepare the Mannich product additives (ii) may each comprise a mixture of compounds and/or a mixture of isomers.

The Mannich additive is preferably the reaction product obtained by reacting components (a), (b) and (c) in a molar ratio of from 5:1:5 to 0.1:1:0.1, more preferably from 3:1:3 to 0.5:1:0.5.

To form the Mannich additive of the present invention components (a) and (b) are preferably reacted in a molar ratio of from 6:1 to 1:4 (aldehyde:amine), preferably from 4:1 to 1:2, more preferably from 3:1 to 1:1.

In preferred embodiments the molar ratio of component (a) to component (b) (aldehyde:amine) in the reaction mixture is preferably greater than 1:1, preferably at least 1.1:1, more preferably at least 1.3:1, suitably at least 1.5:1, for example at least 1.6:1.

Preferably, the molar ratio of component (a) to component (b) (aldehyde:amine) in the reaction mixture is less than 3:1, preferably up to 2.7:1, more preferably up to 2.3:1, for example up to 2.1:1, or up to 2:1.

Preferably, the molar ratio of component (a) to component (b) (aldehyde:amine) in the reaction mixture used to prepare the Mannich additive of the present invention is from 1.1:1 to 2.9:1, preferably from 1.3:1 to 2.7:1, preferably from 1.4:1 to 2.5:1, more preferably from 1.5:1 to 2.3:1, suitably from 1.6:1 to 2.2:1, for example from 1.7:1 to 2.1:1.

To form a preferred Mannich additive of the present invention the molar ratio of component (a) to component (c) (aldehyde:phenol) in the reaction mixture is preferably from 5:1 to 1:4, preferably from 3:1 to 1:2, for example from 2:1 to 1:1.

In preferred embodiments the molar ratio of component (a) to component (c) (aldehyde:phenol) in the reaction mixture used to prepare the Mannich additive of the present invention is greater than 1:1; preferably at least 1.1:1; preferably at least 1.2:1 and more preferably at least 1.3:1.

Preferably the molar ratio of component (a) to component (c) (aldehyde:phenol) is less than 2:1, preferably up to 1.9:1; more preferably up to 1.8:1 for example up to 1.7:1; more preferably up to 1.6:1.

Suitably the molar ratio of component (a) to component (c) (aldehyde:phenol) in the reaction mixture used to prepare the Mannich additive is from 1.05:1 to 1.95:1, preferably from 1.1:1 to 1.85:1, more preferably from 1.2:1 to 1.75:1, suitably from 1.25:1 to 1.65:, most preferably from 1.3:1 to 1.55:1.

To form the Mannich additive of the present invention components (c) and (b) are preferably reacted in a molar ratio of from 6:1 to 1:4 (phenol:amine), preferably from 4:1 to 1:2, more preferably from 3:1 to 1:2 and more preferably from 2:1 to 1:2.

Suitably the molar ratio of component (c) to component (b) (phenol:amine) in the reaction mixture is 0.7:1 to 1.9:1, preferably 0.8:1 to 1.8:1, preferably 0.9:1 to 1.7:1, preferably 1:1 to 1.6:1 preferably 1.1:1 to 1.5:1, preferably 1.2:1 to 1.4:1.

In preferred embodiments, the molar ratio of component (c) to component (b) (phenol:amine) in the reaction mixture is greater than 0.5:1; preferably at least 0.8:1; preferably at least 0.9:1 and more preferably at least 1:1 for example at least 1.1:1.

Preferably the molar ratio of component (c) to component (b) (phenol:amine) in the reaction mixture is less than 2:1, preferably up to 1.9:1; more preferably up to 1.7:1 for example up to 1.6:1; more preferably up to 1.5:1.

In some preferred embodiments in the Mannich reaction used to form the additive the molar ratio of component (a) to component (b) is 2.2-1.01:1; the molar ratio of component (a) to component (c) is 1.99-1.01:1 and the molar ratio of component (b) to component (c) is 1:1.01-1.99.

In some preferred embodiments in the reaction used to make the Mannich additive the molar ratio of component (a) to component (b) is 2-1.6:1, the molar ratio of component (a) to component (c) is 1.6-1.2:1 and the molar ratio of component (b) to component (c) is 1:1.1-1.5.

Some preferred compounds used in the present invention are typically formed by reacting components (a), (b) and (c) in a molar ratio of 1.8 parts (a)±0.3 parts (a), to 1 part (b), to 1.3 parts (c)±0.3 parts (c); preferably 1.8 parts (a)±0.1 parts (a), to 1 part (b), to 1.3 parts (c)±0.1 parts (c); preferably approximately 1.8:1:1.3 (a:b:c).

Suitable treat rates of the quaternary ammonium salt additive and when present the Mannich additive will depend on the desired performance and on the type of engine in which they are used. For example different levels of additive may be needed to achieve different levels of performance.

Suitably the quaternary ammonium salt additive is present in the diesel fuel composition in an amount of from 1 to 10000 ppm, preferably from 1 to 1000 ppm, more preferably from 5 to 500 ppm, suitably from 5 to 250 ppm, for example from 5 to 150 ppm.

Suitably the Mannich additive when used is present in the diesel fuel composition in an amount of from 1 to 10000 ppm, preferably from 1 to 1000 ppm, more preferably from 5 to 500 ppm, suitably from 5 to 250 ppm, for example from 5 to 150 ppm.

The weight ratio of the quaternary ammonium salt additive to the Mannich additive is preferably from 1:10 to 10:1, preferably from 1:4 to 4:1, for example from 1:3 to 3:1.

As stated previously, fuels containing biodiesel or metals are known to cause fouling. Severe fuels, for example those containing high levels of metals and/or high levels of biodiesel may require higher treat rates of the quaternary ammonium salt additive and/or Mannich additive than fuels which are less severe.

The diesel fuel composition of the present invention may include one or more further additives such as those which are commonly found in diesel fuels. These include, for example, antioxidants, dispersants, detergents, metal deactivating compounds, wax anti-settling agents, cold flow improvers, cetane improvers, dehazers, stabilisers, demulsifiers, antifoams, corrosion inhibitors, lubricity improvers, dyes, markers, combustion improvers, metal deactivators, odour masks, drag reducers and conductivity improvers. Examples of suitable amounts of each of these types of additives will be known to the person skilled in the art.

In some preferred embodiments the compositon additionally comprises a detergent of the type formed by the reaction of a polyisobutene-substituted succinic acid-derived acylating agent and a polyethylene polyamine. Suitable compounds are, for example, described in WO2009/040583.

By diesel fuel we include any fuel suitable for use in a diesel engine, either for road use or non-road use. This includes, but is not limited to, fuels described as diesel, marine diesel, heavy fuel oil, industrial fuel oil etc.

The diesel fuel composition of the present invention may comprise a petroleum-based fuel oil, especially a middle distillate fuel oil. Such distillate fuel oils generally boil within the range of from 110° C. to 500° C., e.g. 150° C. to 400° C. The diesel fuel may comprise atmospheric distillate or vacuum distillate, cracked gas oil, or a blend in any proportion of straight run and refinery streams such as thermally and/or catalytically cracked and hydro-cracked distillates.

The diesel fuel composition of the present invention may comprise a Fischer-Tropsch fuel. It may comprise non-renewable Fischer-Tropsch fuels such as those described as GTL (gas-to-liquid) fuels, CTL (coal-to-liquid) fuels and OTL (oil sands-to-liquid).

The diesel fuel composition of the present invention may comprise a renewable fuel such as a biofuel composition or biodiesel composition.

The diesel fuel composition may comprise 1st generation biodiesel. First generation biodiesel contains esters of, for example, vegetable oils, animal fats and used cooking fats. This form of biodiesel may be obtained by transesterification of oils, for example rapeseed oil, soybean oil, safflower oil, palm 25 oil, corn oil, peanut oil, cotton seed oil, tallow, coconut oil, physic nut oil (Jatropha), sunflower seed oil, used cooking oils, hydrogenated vegetable oils or any mixture thereof, with an alcohol, usually a monoalcohol, in the presence of a catalyst.

The diesel fuel composition may comprise second generation biodiesel. Second generation biodiesel is derived from renewable resources such as vegetable oils and animal fats and processed, often in the refinery, often using hydroprocessing such as the H-Bio process developed by Petrobras. Second generation biodiesel may be similar in properties and quality to petroleum based fuel oil streams, for example renewable diesel produced from vegetable oils, animal fats etc. and marketed by ConocoPhillips as Renewable Diesel and by Neste as NExBTL.

The diesel fuel composition of the present invention may comprise third generation biodiesel. Third generation biodiesel utilises gasification and Fischer-Tropsch technology including those described as BTL (biomass-to-liquid) fuels. Third generation biodiesel does not differ widely from some second generation biodiesel, but aims to exploit the whole plant (biomass) and thereby widens the feedstock base.

The diesel fuel composition may contain blends of any or all of the above diesel fuel compositions.

In some embodiments the diesel fuel comprises a non-renewable Fischer Tropsch fuel and/or biodiesel.

In some embodiments the diesel fuel composition of the present invention may be a blended diesel fuel comprising bio-diesel. In such blends the bio-diesel may be present in an amount of, for example up to 0.5%, up to 1%, up to 2%, up to 3%, up to 4%, up to 5%, up to 10%, up to 20%, up to 30%, up to 40%, up to 50%, up to 60%, up to 70%, up to 80%, up to 90%, up to 95% or up to 99%.

In some embodiments the diesel fuel composition may comprise a secondary fuel, for example ethanol. Preferably however the diesel fuel composition does not contain ethanol.

The diesel fuel composition of the present invention may contain a relatively high sulphur content, for example greater than 0.05% by weight, such as 0.1% or 0.2%.

However in preferred embodiments the diesel fuel has a sulphur content of at most 0.05% by weight, more preferably of at most 0.035% by weight, especially of at most 0.015%. Fuels with even lower levels of sulphur are also suitable such as, fuels with less than 50 ppm sulphur by weight, preferably less than 20 ppm, for example 10 ppm or less.

Commonly when present, metal-containing species will be present as a contaminant, for example through the corrosion of metal and metal oxide surfaces by acidic species present in the fuel or from lubricating oil. In use, fuels such as diesel fuels routinely come into contact with metal surfaces for example, in vehicle fuelling systems, fuel tanks, fuel transportation means etc. Typically, metal-containing contamination may comprise transition metals such as zinc, iron and copper; group I or group II metals such as sodium; and other metals such as lead.

In addition to metal-containing contamination which may be present in diesel fuels there are circumstances where metal-containing species may deliberately be added to the fuel. For example, as is known in the art, metal-containing fuel-borne catalyst species may be added to aid with the regeneration of particulate traps. Such catalysts are often based on metals such as iron, cerium, Group I and Group II metals e.g., calcium and strontium, either as mixtures or alone. Also used are platinum and manganese. The presence of such catalysts may also give rise to injector deposits when the fuels are used in diesel engines having high pressure fuel systems.

Metal-containing contamination, depending on its source, may be in the form of insoluble particulates or soluble compounds or complexes. Metal-containing fuel-borne catalysts are often soluble compounds or complexes or colloidal species.

In some embodiments, the metal-containing species comprises a fuel-borne catalyst.

In some embodiments, the metal-containing species comprises zinc.

In one preferred embodiment the diesel fuel composition of the invention comprises a fuel-borne catalyst which includes a metal selected from iron, cerium, group I and group II metals, platinum, manganese and mixtures thereof. Preferred group I and group II metals include calcium and strontium.

Typically, the amount of metal-containing species in the diesel fuel, expressed in terms of the total weight of metal in the species, is between 0.1 and 50 ppm by weight, for example between 0.1 and 10 ppm by weight, based on the weight of the diesel fuel.

The fuel compositions of the present invention show improved performance when used in diesel engines having high pressure fuel systems compared with diesel fuels of the prior art.

According to a second aspect of the present invention there is provided an additive package which upon addition to a diesel fuel provides a composition of the first aspect.

The additive package may comprise a mixture of the quaternary ammonium salt additive, the Mannich additive and optionally further additives, for example those described above. Alternatively the additive package may comprise a solution of additives, suitably in a mixture of hydrocarbon solvents for example aliphatic and/or aromatic solvents; and/or oxygenated solvents for example alcohols and/or ethers.

According to a third aspect of the present invention there is provided a method of operating a diesel engine, the method comprising combusting in the engine a composition of the first aspect.

According to a fourth aspect of the present invention there is provided the use of a quaternary ammonium salt additive (i) and a Mannich reaction product additive (ii) in a diesel fuel composition to improve the engine performance of a diesel engine when using said diesel fuel composition.

Preferred features of the second, third and fourth aspects are as defined in relation to the first aspect.

The improvement in performance may be achieved by the reduction or the prevention of the formation of deposits in a diesel engine. This may be regarded as an improvement in "keep clean" performance. Thus the present invention may provide a method of reducing or preventing the formation of deposits in a diesel engine by combusting in said engine a composition of the first aspect.

The improvement in performance may be achieved by the removal of existing deposits in a diesel engine. This may be regarded as an improvement in "clean up" performance. Thus the present invention may provide a method of removing deposits from a diesel engine by combusting in said engine a composition of the first aspect.

In especially preferred embodiments the composition of the first aspect of the present invention may be used to provide an improvement in "keep clean" and "clean up" performance.

In some preferred embodiments the use of the third aspect may relate to the use of a quaternary ammonium salt additive, optionally in combination with a Mannich additive, in a diesel fuel composition to improve the engine performance of a diesel engine when using said diesel fuel composition wherein the diesel engine has a high pressure fuel system.

Modern diesel engines having a high pressure fuel system may be characterised in a number of ways. Such engines are typically equipped with fuel injectors having a plurality of apertures, each aperture having an inlet and an outlet.

Such modern diesel engines may be characterised by apertures which are tapered such that the inlet diameter of the spray-holes is greater than the outlet diameter.

Such modern engines may be characterised by apertures having an outlet diameter of less than 500 μm, preferably less than 200 μm, more preferably less than 150 μm, preferably less than 100 μm, most preferably less than 80 μm or less.

Such modern diesel engines may be characterised by apertures where an inner edge of the inlet is rounded.

Such modern diesel engines may be characterised by the injector having more than one aperture, suitably more than 2 apertures, preferably more than 4 apertures, for example 6 or more apertures.

Such modern diesel engines may be characterised by an operating tip temperature in excess of 250° C.

Such modern diesel engines may be characterised by a fuel pressure of more than 1350 bar, preferably more than 1500 bar, more preferably more than 2000 bar.

The use of the present invention preferably improves the performance of an engine having one or more of the above-described characteristics.

The present invention is particularly useful in the prevention or reduction or removal of deposits on injectors of engines operating at high pressures and temperatures in which fuel may be recirculated and which comprise a plurality of fine apertures through which the fuel is delivered to the engine. The present invention finds utility in engines for heavy duty vehicles and passenger vehicles. Passenger vehicles incorporating a high speed direct injection (or HSDI) engine may for example benefit from the present invention.

Within the injector body of modern diesel engines having a high pressure fuel system, clearances of only 1-2 μm may exist between moving parts and there have been reports of engine problems in the field caused by injectors sticking and particularly injectors sticking open. Control of deposits in this area can be very important.

The diesel fuel compositions of the present invention may also provide improved performance when used with traditional diesel engines. Preferably the improved performance is achieved when using the diesel fuel compositions in modern diesel engines having high pressure fuel systems and when using the compositions in traditional diesel engines. This is important because it allows a single fuel to be provided that can be used in new engines and older vehicles.

The improvement in performance of the diesel engine system may be measured by a number of ways. Suitable methods will depend on the type of engine and whether "keep clean" and/or "clean up" performance is measured.

One of the ways in which the improvement in performance can be measured is by measuring the power loss in a controlled engine test. An improvement in "keep clean" performance may be measured by observing a reduction in power loss compared to that seen in a base fuel.

"Clean up" performance can be observed by an increase in power when diesel fuel compositions of the invention are used in an already fouled engine.

The improvement in performance of the diesel engine having a high pressure fuel system may be measured by an improvement in fuel economy.

The use of the third aspect may also improve the performance of the engine by reducing, preventing or removing deposits in the vehicle fuel filter.

The level of deposits in a vehicle fuel filter may be measured quantitatively or qualitatively. In some cases this may only be determined by inspection of the filter once the filter has been removed. In other cases, the level of deposits may be estimated during use.

Many vehicles are fitted with a fuel filter which may be visually inspected during use to determine the level of solids build up and the need for filter replacement. For example, one such system uses a filter canister within a transparent housing allowing the filter, the fuel level within the filter and the degree of filter blocking to be observed.

Using the fuel compositions of the present invention may result in levels of deposits in the fuel filter which are considerably reduced compared with fuel compositions not of the present invention. This allows the filter to be changed much less frequently and can ensure that fuel filters do not fail between service intervals. Thus the use of the compositions of the present invention may lead to reduced maintenance costs.

In some embodiments the occurrence of deposits in a fuel filter may be inhibited or reduced. Thus a "keep clean" performance may be observed. In some embodiments existing deposits may be removed from a fuel filter. Thus a "clean up" performance may be observed.

Improvement in performance may also be assessed by considering the extent to which the use of the fuel compositions of the invention reduce the amount of deposit on the injector of an engine. For "keep clean" performance a reduction in occurrence of deposits would be observed. For "clean up" performance removal of existing deposits would be observed.

Direct measurement of deposit build up is not usually undertaken, but is usually inferred from the power loss or fuel flow rates through the injector.

The use of the third aspect may improve the performance of the engine by reducing, preventing or removing deposits including gums and lacquers within the injector body.

In Europe the Co-ordinating European Council for the development of performance tests for transportation fuels, lubricants and other fluids (the industry body known as CEC), has developed a new test, named CEC F-98-08, to assess whether diesel fuel is suitable for use in engines meeting new European Union emissions regulations known as the "Euro 5" regulations. The test is based on a Peugeot DW10 engine using Euro 5 injectors, and will hereinafter be referred to as the DW10 test. It will be further described in the context of the examples (see example 7).

Preferably the use of the fuel composition of the present invention leads to reduced deposits in the DW10 test. For "keep clean" performance a reduction in the occurrence of deposits is preferably observed. For "clean up" performance removal of deposits is preferably observed. The DW10 test is used to measure the power loss in modern diesel engines having a high pressure fuel system.

For older engines an improvement in performance may be measured using the XUD9 test. This test is described in relation to example 10.

Suitably the use of a fuel composition of the present invention may provide a "keep clean" performance in modern diesel engines, that is the formation of deposits on the injectors of these engines may be inhibited or prevented.

Preferably this performance is such that a power loss of less than 5%, preferably less than 2% is observed after 32 hours as measured by the DW10 test.

Suitably the use of a fuel composition of the present invention may provide a "clean up" performance in modern diesel engines, that is deposits on the injectors of an already fouled engine may be removed. Preferably this performance is such that the power of a fouled engine may be returned to within 1% of the level achieved when using clean injectors within 32 hours as measured in the DW10 test.

Preferably rapid "clean-up" may be achieved in which the power is returned to within 1% of the level observed using clean injectors within 10 hours, preferably within 8 hours, suitably within 6 hours, preferably within 4 hours, more preferably within 2 hours.

Clean injectors can include new injectors or injectors which have been removed and physically cleaned, for example in an ultrasound bath.

Suitably the use of a fuel composition of the present invention may provide a "keep clean" performance in traditional diesel engines, that is the formation of deposits on the injectors of these engines may be inhibited or prevented. Preferably this performance is such that a flow loss of less than 50%, preferably less than 30% is observed after 10 hours as measured by the XUD-9 test.

Suitably the use of a fuel composition of the present invention may provide a "clean up" performance in traditional diesel engines, that is deposits on the injectors of an already fouled engine may be removed. Preferably this performance is such that the flow loss of a fouled engine may be increased by 10% or more within 10 hours as measured in the XUD-9 test.

Any feature of any aspect of the invention may be combined with any other feature, where appropriate.

The invention will now be further defined with reference to the following non-limiting examples.

EXAMPLE 1

Additive A, the reaction product of a hydrocarbyl substituted acylating agent and a compound of formula (B1) was prepared as follows:

523.88 g (0.425 moles) PIBSA (made from 1000 MW PIB and maleic anhydride) and 373.02 g Caromax 20 were charged to 1 litre vessel. The mixtures was stirred and heated, under nitrogen to 50° C. 43.69 g (0.425 moles) dimethylaminopropylamine was added and the mixture heated to 160° C. for 5 hours, with concurrent removal of water using a Dean-Stark apparatus.

EXAMPLE 2

Additive B, a quaternary ammonium salt additive of the present invention was prepared as follows:

588.24 g (0.266 moles) of Additive A mixed with 40.66 g (0.266 moles) methyl salicylate under nitrogen. The mixture was stirred and heated to 160° C. for 16 hours. The product contained 37.4% solvent. The non-volatile material contained 18% of the quaternary ammonium salt as determined by titration.

EXAMPLE 3

A polyisobutene-substituted phenol was prepared as follows:

Polyisobutene having an average molecular weight of 750 (450.3 g, 0.53 mol, 1 equiv) was heated to 45-50° C. and then phenol (150.0 g, 1.59 mol, 3 equivs) was added. The turbid mixture was stirred and boron trifluoride dietherate (15.0 g, 0.10 mol, 0.18 equivs) was added in 2-3 ml aliquots over approx two hours to provide a clear orange liquid which was stirred at 45-50° C. for 5 hours. Aqueous ammonia 35% (10.5 g, 0.22 moles) was then added and the reaction mixture stirred for 30 mins. Vacuum distillation provided 81.3 g of distillate. This was stirred at 70° C. in toluene (250.3 g) for 5 mins, before adding 250.4 g of water. The layers were separated and the toluene extract was washed twice more with water. Residual water and toluene removed under vacuum to provide the product as a viscous pale yellow liquid. (510.9 g) having a toluene content of 2 wt % and a phenol content of less than 0.2 wt %.

EXAMPLE 4

Additive C, a Mannich additive of the present invention was prepared as follows:

PIB 750 Phenol (a phenol having a polyisobutenyl substituent of average molecular weight 750) with a residual PIB content of 5 wt % (447.8 g, 425.4 g "active" PIB phenol, 0.50 moles, 1.3 equivs) was mixed with ethylenediamine (25.3 g, 0.38 moles, 1 equiv) and Caromax 20 solvent (225.6 g). The homogenous mixture was heated to 90-95° C. 36.7% formalin (57.12 g, 0.69 moles, 1.8 equivs) was then added over 1 hr and the reaction mixture was then held at 95° C. for 1 hr. Water was removed using a Dean-Stark apparatus. Following distillation 708.3 g product was collected.

EXAMPLE 5

Additive D, a quaternary ammonium salt additive of the present invention was prepared as follows:

33.9 kg (27.3 moles) of a polyisobutyl-substituted succinic anhydride having a PIB molecular weight of 1000 was heated to 90° C. 2.79 kg (27.3 moles) dimethylaminopropylamine was added and the mixture stirred at 90 to 100° C. for 1 hour. The temperature was increased to 140° C. for 3 hours with concurrent removal of water. 25 kg of 2-ethyl hexanol was added, followed by 4.15 kg methyl salicylate (27.3 moles) and the mixture maintained at 140° C. for 9.5 hours.

EXAMPLE 6

Diesel fuel compositions were prepared by adding the specified additives to aliquots all drawn from a common batch of RF06 base fuel, and containing 1 ppm zinc (as zinc neodecanoate).

Table 1 below shows the specification for RF06 base fuel.

TABLE 1

| | | Limits | | |
|---|---|---|---|---|
| Property | Units | Min | Max | Method |
| Cetane Number | | 52.0 | 54.0 | EN ISO 5165 |
| Density at 15° C. | $kg/m^3$ | 833 | 837 | EN ISO 3675 |
| Distillation | | | | |
| 50% v/v Point | ° C. | 245 | — | |
| 95% v/v Point | ° C. | 345 | 350 | |
| FBP | ° C. | — | 370 | |
| Flash Point | ° C. | 55 | — | EN 22719 |
| Cold Filter Plugging Point | ° C. | — | −5 | EN 116 |
| Viscosity at 40° C. | $mm^2/sec$ | 2.3 | 3.3 | EN ISO 3104 |

TABLE 1-continued

| Property | Units | Limits Min | Max | Method |
|---|---|---|---|---|
| Polycyclic Aromatic Hydrocarbons | % m/m | 3.0 | 6.0 | IP 391 |
| Sulphur Content | mg/kg | — | 10 | ASTM D 5453 |
| Copper Corrosion | | — | 1 | EN ISO 2160 |
| Conradson Carbon Residue on 10% Dist. Residue | % m/m | — | 0.2 | EN ISO 10370 |
| Ash Content | % m/m | — | 0.01 | EN ISO 6245 |
| Water Content | % m/m | — | 0.02 | EN ISO 12937 |
| Neutralisation (Strong Acid) Number | mg KOH/g | — | 0.02 | ASTM D 974 |
| Oxidation Stability | mg/mL | — | 0.025 | EN ISO 12205 |
| HFRR (WSD1, 4) | µm | — | 400 | CEC F-06-A-96 |
| Fatty Acid Methyl Ester | | prohibited | | |

EXAMPLE 7

A diesel fuel composition was prepared by adding 107.5 ppm of the crude material obtained in example 4 (additive C) and 107.5 ppm of the crude material obtained in example 5 (additive D) to an RF06 base fuel meeting the specification given in table 1 above (example 6) together with 1 ppm zinc as zinc neodecanoate. This fuel composition was tested according to the CECF-98-08 DW 10 method.

The engine of the injector fouling test is the PSA DW10BTED4. In summary, the engine characteristics are:

Design: Four cylinders in line, overhead camshaft, turbocharged with EGR

Capacity: 1998 $cm^3$

Combustion chamber: Four valves, bowl in piston, wall guided direct injection

Power: 100 kW at 4000 rpm

Torque: 320 Nm at 2000 rpm

Injection system: Common rail with piezo electronically controlled 6-hole injectors.

Max. pressure: 1600 bar ($1.6\times10^8$ Pa). Proprietary design by SIEMENS VDO

Emissions control: Conforms with Euro IV limit values when combined with exhaust gas post-treatment system (DPF)

This engine was chosen as a design representative of the modern European high-speed direct injection diesel engine capable of conforming to present and future European emissions requirements. The common rail injection system uses a highly efficient nozzle design with rounded inlet edges and conical spray holes for optimal hydraulic flow. This type of nozzle, when combined with high fuel pressure has allowed advances to be achieved in combustion efficiency, reduced noise and reduced fuel consumption, but are sensitive to influences that can disturb the fuel flow, such as deposit formation in the spray holes. The presence of these deposits causes a significant loss of engine power and increased raw emissions. The test is run with a future injector design representative of anticipated Euro V injector technology.

It is considered necessary to establish a reliable baseline of injector condition before beginning fouling tests, so a sixteen hour running-in schedule for the test injectors is specified, using non-fouling reference fuel.

Full details of the CEC F-98-08 test method can be obtained from the CEC. The coking cycle is summarised below.

1. A warm up cycle (12 minutes) according to the following regime:

| Step | Duration (minutes) | Engine Speed (rpm) | Torque (Nm) |
|---|---|---|---|
| 1 | 2 | idle | <5 |
| 2 | 3 | 2000 | 50 |
| 3 | 4 | 3500 | 75 |
| 4 | 3 | 4000 | 100 |

2. 8 hrs of engine operation consisting of 8 repeats of the following cycle

| Step | Duration (minutes) | Engine Speed (rpm) | Load (%) | Torque (Nm) | Boost Air After IC (° C.) |
|---|---|---|---|---|---|
| 1 | 2 | 1750 | (20) | 62 | 45 |
| 2 | 7 | 3000 | (60) | 173 | 50 |
| 3 | 2 | 1750 | (20) | 62 | 45 |
| 4 | 7 | 3500 | (80) | 212 | 50 |
| 5 | 2 | 1750 | (20) | 62 | 45 |
| 6 | 10 | 4000 | 100 | * | 50 |
| 7 | 2 | 1250 | (10) | 20 | 43 |
| 8 | 7 | 3000 | 100 | * | 50 |
| 9 | 2 | 1250 | (10) | 20 | 43 |
| 10 | 10 | 2000 | 100 | * | 50 |
| 11 | 2 | 1250 | (10) | 20 | 43 |
| 12 | 7 | 4000 | 100 | * | 50 |

* for expected range see CEC method CEC-F-98-08

3. Cool down to idle in 60 seconds and idle for 10 seconds
4. 4 hrs soak period

The standard CEC F-98-08 test method consists of 32 hours engine operation corresponding to 4 repeats of steps 1-3 above, and 3 repeats of step 4. ie 56 hours total test time excluding warm ups and cool downs.

In each case, a first 32 hour cycle was run using new injectors and RF-06 base fuel having added thereto 1 ppm Zn (as neodecanoate). This resulted in a level of power loss due to fouling of the injectors.

A second 32 hour cycle was then run as a clean up' phase. The dirty injectors from the first phase were kept in the engine and the fuel changed to RF-06 base fuel having added thereto 1 ppm Zn (as neodecanoate) and the test additives specified above.

The result of the test is shown in FIG. 1.

EXAMPLE 8

Additive E, a quaternary ammonium salt additive of the present invention was prepared as follows:

45.68 g (0.0375 moles) of Additive A was mixed with 15 g (0.127 moles) dimethyl oxalate and 0.95 g octanoic acid. The mixture was heated to 120° C. for 4 hours. Excess dimethyl oxalate was removed under vacuum. 35.10 g of product was diluted with 23.51 g Caromax 20.

EXAMPLE 9

Additive F, a quaternary ammonium salt additive of the present invention was prepared as follows:

315.9 g (0.247 moles) of a polyisobutyl-substituted succinic anhydride having a PIB molecular weight of 1000 was mixed with 66.45 g (0.499 moles) 2-(2-dimethylaminoethoxy)ethanol and 104.38 g Caromax 20. The mixture was heated to 200° C. with removal of water. The solvent was removed under vacuum. 288.27 g (0.191 mol) of this product was reacted with 58.03 g (0.381 mol) methyl salicylate at 150° C. overnight and then 230.9 g Caromax 20 was added.

EXAMPLE 10

The effectiveness of the additives of the present invention in older engine types may be assessed using a standard industry test—CEC test method No. CEC F-23-A-01.

This test measures injector nozzle coking using a Peugeot XUD9 NL Engine and provides a means of discriminating between fuels of different injector nozzle coking propensity. Nozzle coking is the result of carbon deposits forming between the injector needle and the needle seat. Deposition of the carbon deposit is due to exposure of the injector needle and seat to combustion gases, potentially causing undesirable variations in engine performance.

The Peugeot XUD9 A/L engine is a 4 cylinder indirect injection Diesel engine of 1.9 litre swept volume, obtained from Peugeot Citroen Motors specifically for the CEC PF023 method.

The test engine is fitted with cleaned injectors utilising unflatted injector needles. The airflow at various needle lift positions have been measured on a flow rig prior to test. The engine is operated for a period of 10 hours under cyclic conditions.

| Stage | Time (secs) | Speed (rpm) | Torque (Nm) |
|---|---|---|---|
| 1 | 30 | 1200 ± 30 | 10 ± 2 |
| 2 | 60 | 3000 ± 30 | 50 ± 2 |
| 3 | 60 | 1300 ± 30 | 35 ± 2 |
| 4 | 120 | 1850 ± 30 | 50 ± 2 |

The propensity of the fuel to promote deposit formation on the fuel injectors is determined by measuring the injector nozzle airflow again at the end of test, and comparing these values to those before test. The results are expressed in terms of percentage airflow reduction at various needle lift positions for all nozzles. The average value of the airflow reduction at 0.1 mm needle lift of all four nozzles is deemed the level of injector coking for a given fuel.

EXAMPLE 11

Additive G, a quaternary ammonium salt additive of the present invention was prepared as follows:

33.9 kg (27.3 moles) of a polyisobutyl-substituted succinic anhydride having a PIB molecular weight of 1000 was heated to 90° C. 2.79 kg (27.3 moles) dimethylaminopropylamine was added and the mixture stirred at 90 to 100° C. for 1 hour. The temperature was increased to 140° C. for 3 hours with concurrent removal of water. 25 kg of 2-ethyl hexanol was added, followed by 4.15 kg methyl salicylate (27.3 moles) and the mixture maintained at 140° C. for 9.5 hours.

EXAMPLE 12

Additive H, a quaternary ammonium salt additive of the present invention was prepared as follows:

A polyisobutyl-substituted succinic anhydride having a PIB molecular weight of 260 was reacted with dimethylaminopropylamine using a method analogous to that described in example 10. 213.33 g (0.525 moles) of this material was added to 79.82 (0.525 moles) methyl salicylate and the mixture heated to 140° C. for 24 hours before the addition of 177 g 2-ethylhexanol.

EXAMPLE 13

Additive J, a quaternary ammonium salt additive of the present invention was prepared as follows:

A reactor was charged with 201.13 g (0.169 mol) additive A, 69.73 g (0.59 mol) dimethyl oxalate and 4.0 g 2-ethyl hexanoic acid. The mixture was heated to 120° C. for 4 hours. Excess dimethyl oxalate was removed under vacuum and 136.4 g Caromax 20 was added.

EXAMPLE 14

Additive K, a quaternary ammonium salt additive of the present invention was prepared as follows:

251.48 g (0.192 mol) of a polyisobutyl-substituted succinic anhydride having a PIB molecular weight of 1000 and 151.96 g toluene were heated to 80° C. 35.22 g (0.393 mol) N,N-dimethyl-2-ethanolamine was added and the mixture heated to 140° C. 4 g of Amberlyst catalyst was added and mixture reacted overnight before filtration and removal of solvent. 230.07 g (0.159 mol) of this material was reacted with 47.89 g (0.317 mol) methyl salicylate at 142° C. overnight before the addition of 186.02 g Caromax 20.

EXAMPLE 15

Additive L, a quaternary ammonium salt additive of the present invention was prepared as follows:

A polyisobutyl-substituted succinic anhydride having a PIB molecular weight of 1300 was reacted with dimethylaminopropylamine using a method analogous to that described in example 10. 20.88 g (0.0142 mol) of this material was mixed with 2.2 g (0.0144 mol) methyl salicylate and 15.4 g 2-ethylhexanol. The mixture was heated to 140° C. for 24 hours.

EXAMPLE 16

Additive M, a quaternary ammonium salt additive of the present invention was prepared as follows:

A polyisobutyl-substituted succinic anhydride having a PIB molecular weight of 2300 was reacted with dimethylaminopropylamine using a method analogous to that described in example 10. 23.27 g (0.0094 mol) of this material was mixed with 1.43 g (0.0094 mol) methyl salicylate and 16.5 g 2-ethylhexanol. The mixture was heated to 140° C. for 24 hours.

EXAMPLE 17

A polyisobutyl-substituted succinic anhydride having a PIB molecular weight of 750 was reacted with dimethylaminopropylamine using a method analogous to that described in example 10. 31.1 g (0.034 mol) of this material was mixed with 5.2 g (0.034 mol) methyl salicylate and 24.2 g 2-ethylhexanol. The mixture was heated to 140° C. for 24 hours.

EXAMPLE 18

61.71 g (0.0484 mol) of a polyisobutyl-substituted succinic anhydride having a PIB molecular weight of 1000 was heated to 74° C. 9.032 g (0.0485 mol) dibutylaminopropylamine was added and the mixture heated to 135° C. for 3 hours with removal of water. 7.24 g (0.0476 mol) methyl salicylate was added and the mixture reacted overnight before the addition of 51.33 g Caromax 20.

EXAMPLE 19

157.0 g (0.122 mol) of a polyisobutyl-substituted succinic anhydride having a PIB molecular weight of 1000 and 2-ethylhexanol (123.3 g) were heated to 140° C. Benzyl salicylate (28.0 g, 0.123 mol) added and mixture stirred at 140° C. for 24 hours.

EXAMPLE 20

18.0 g (0.0138 mol) of additive A and 2-ethylhexanol (12.0 g) were heated to 140° C. Methyl 2-nitrobenzoate (2.51 g, 0.0139 mol) was added and the mixture stirred at 140° C. for 12 hours.

The invention claimed is:

1. A diesel fuel composition comprising a first additive (i) comprising a quaternary ammonium salt and a second additive (ii) comprising a Mannich reaction product;

wherein the quaternary ammonium salt additive (i) is formed by the reaction of a compound of formula (A):

(A)

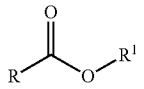

wherein the compound of formula (A) is an ester of a carboxylic acid selected from the group consisting of a substituted aromatic carboxylic acid and a polycarboxylic acid, and a compound formed by the reaction of a hydrocarbyl-substituted acylating agent and an amine of formula (B1) or (B2):

(B1)

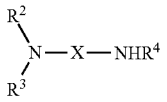

(B2)

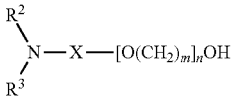

wherein R is an optionally substituted alkyl, alkenyl, aryl or alkylaryl group; $R^1$ is a $C_1$ to $C_{22}$ alkyl, aryl or alkylaryl group; wherein $R^2$ and $R^3$ are the same or different alkyl, alkenyl or aryl groups having from 1 to 22 carbon atoms; X is a bond or alkylene group having from 1 to 20carbon atoms; n is from 0 to 20; m is from 1 to 5; and $R^4$ is hydrogen or a $C_1$ to $C_{22}$ alkyl group; and wherein the Mannich reaction product additive (ii) is the product of a Mannich reaction between:

(a) an aldehyde;

(b) an amine; and (c) a substituted phenol;

wherein the phenol is substituted with at least one branched hydrocarbyl group having a molecular weight of between 400 and 3000.

2. The diesel fuel composition according to claim 1 wherein the compound of formula (A) is selected from dimethyl oxalate, methyl 2-nitrobenzoate and methyl salicylate.

3. The diesel fuel composition according to claim 1 wherein the hydrocarbyl substituted acylating agent is reacted with a diamine compound of formula (B1).

4. The diesel fuel composition according to claim 1 wherein additive (i) is a salt of tertiary amine prepared from dimethylaminopropylamine and a polyisobutylene-substituted succinic anhydride.

5. The diesel fuel composition according to claim 1 wherein component (a) used to prepare additive (ii) is formaldehyde.

6. The diesel fuel composition according to claim 1 wherein component (b) used to prepare additive (ii) is a (poly)ethylene polyamine.

7. The diesel fuel composition according to claim 1 wherein component (c) used to prepare additive (ii) is a polyisobutylene-substituted phenol.

8. The diesel fuel composition according to claim 1 wherein in the Mannich reaction used to form additive (ii) the molar ratio of component (a) to component (b) is 2.2-1.01:1; the molar ratio of component (a) to component (c) is 1.99-1.01:1 and the molar ratio of component (b) to component (c) is 1:1.01-1.99.

9. The diesel fuel composition according to claim 8 wherein in the reaction used to make the Mannich additive the molar ratio of component (a) to component (b) is 2-1.4:1, the molar ratio of component (a) to component (c) is 1.7-1.1:1 and the molar ratio of component (b) to component (c) is 1:1.1-1.7.

10. The diesel fuel composition according to claim 1 wherein the diesel fuel comprises a Fischer Tropsch fuel and/or biodiesel.

11. The diesel fuel composition according to claim 1 which further comprises a fuel-borne catalyst which includes a metal selected from iron, cerium, group I and group II metals, platinum, manganese and mixtures thereof.

12. An additive package which upon addition to a diesel fuel provides a composition as claimed in claim 1.

13. A method of operating a diesel engine, the method comprising combusting in the engine a composition as claimed in claim 1.

* * * * *